US011111772B2

(12) United States Patent
Beisel

(10) Patent No.: US 11,111,772 B2
(45) Date of Patent: Sep. 7, 2021

(54) BULK MODULUS MONITORING SYSTEM

(71) Applicant: Halliburton Energy Services, Inc., Houston, TX (US)

(72) Inventor: Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 754 days.

(21) Appl. No.: 15/749,651

(22) PCT Filed: Sep. 29, 2015

(86) PCT No.: PCT/US2015/052877
§ 371 (c)(1),
(2) Date: Feb. 1, 2018

(87) PCT Pub. No.: WO2017/058161
PCT Pub. Date: Apr. 6, 2017

(65) Prior Publication Data

US 2018/0223644 A1 Aug. 9, 2018

(51) Int. Cl.
*E21B 47/009* (2012.01)
*F04B 49/22* (2006.01)
(Continued)

(52) U.S. Cl.
CPC ..... *E21B 47/009* (2020.05); *F04B 1/053* (2013.01); *F04B 9/045* (2013.01); *F04B 47/02* (2013.01);
(Continued)

(58) Field of Classification Search
CPC ..... E21B 47/0008; F05B 1/053; F04B 9/045; F04B 4/04; F04B 49/00; F04B 49/065;
(Continued)

(56) References Cited

U.S. PATENT DOCUMENTS 4,705,459 A * 11/1987 Buisine ..... F04B 51/00 417/53
6,882,960 B2 4/2005 Miller
(Continued)

FOREIGN PATENT DOCUMENTS

EP 1519185 3/2005
WO 2002025244 3/2002
WO WO-2014204316 A1 * 12/2014 ..... F04B 51/00

OTHER PUBLICATIONS

International Patent Application No. PCT/US2015/052877, "International Search Report and Written Opinion", dated Jun. 29, 2016, 8 pages.

*Primary Examiner* — Regis J Betsch
*Assistant Examiner* — Kaleria Knox
(74) *Attorney, Agent, or Firm* — Kilpatrick Townsend & Stockton LLP

(57) ABSTRACT

A monitoring system may include at least a strain gauge and a computing device for determining a bulk modulus of a fluid system of a pressure pump using strain measurements. The strain gauge may determine strain in a chamber of the pressure pump. The computing device may receive a strain signal generated by the strain gauge and may correlate the strain signal to pressure to determine a change in pressure during a period in which fluid is isolated in the chamber. The computing device may use the change in pressure during this period to determine a bulk modulus of the fluid system.

20 Claims, 10 Drawing Sheets

(51) Int. Cl.

| | |
|---|---|
| ***F04B 49/06*** | (2006.01) |
| ***F04B 1/053*** | (2020.01) |
| ***F04B 49/00*** | (2006.01) |
| ***F04B 47/02*** | (2006.01) |
| ***F04B 9/04*** | (2006.01) |
| ***F04B 47/04*** | (2006.01) |

(52) U.S. Cl.
CPC ..... *F04B 47/04* (2013.01); *F04B 49/00* (2013.01); *F04B 49/065* (2013.01); *F04B 49/22* (2013.01); *F04B 2201/0201* (2013.01); *F04B 2201/0601* (2013.01); *F04B 2201/1208* (2013.01); *F04B 2205/03* (2013.01)

(58) Field of Classification Search
CPC ..... F04B 49/22; F04B 2201/0601; F04B 2201/1208; F04B 2205/03; F04B 51/00; F04B 53/1077; F04B 53/006
See application file for complete search history.

(56) References Cited

U.S. PATENT DOCUMENTS

| | | | | |
|---|---|---|---|---|
| 7,623,986 | B2 | 11/2009 | Miller | |
| 2004/0013539 | A1* | 1/2004 | Takagi | F04B 53/1077 417/300 |
| 2011/0202275 | A1 | 8/2011 | Beisel et al. | |
| 2014/0166267 | A1 | 6/2014 | Weightman et al. | |
| 2014/0166268 | A1 | 6/2014 | Weightman et al. | |
| 2015/0377318 | A1* | 12/2015 | Byrne | F04B 53/006 700/282 |

* cited by examiner

BULK MODULUS MONITORING SYSTEM

TECHNICAL FIELD

The present disclosure relates generally to pressure pumps for a wellbore and, more particularly (although not necessarily exclusively), to determining bulk modulus or compressibility of a fluid system in a pressure pump using strain measurements.

BACKGROUND

Pressure pumps may be used in wellbore treatments. For example, hydraulic fracturing (also known as "fracking" or "hydro-fracking") may utilize a pressure pump to introduce or inject fluid at high pressures into a wellbore to create cracks or fractures in downhole rock formations. A bulk modulus of the fluid flowing through the pressure pump and introduced into the wellbore provide information with respect to the macroscopic properties of the fluid for predicting accurate displacements or combining with other measurements to extract additional information useful for pumping operations.

DETAILED DESCRIPTION

Figure 1A:
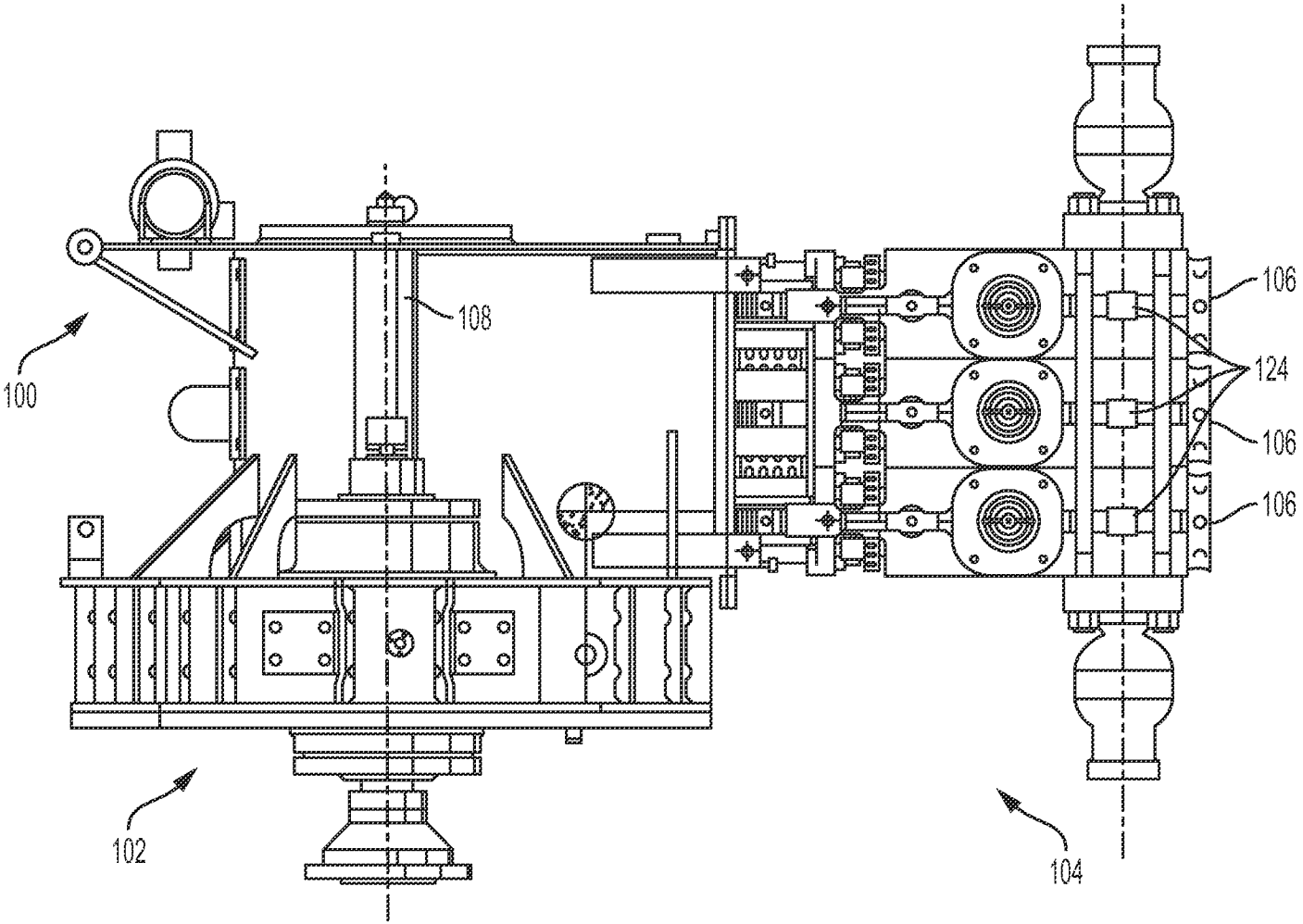
FIG. 1A is a cross-sectional, top view schematic diagram depicting an example of a pressure pump that may include a monitoring system according to one aspect of the present disclosure.

Certain aspects and examples of the present disclosure relate to a monitoring system for determining bulk modulus of a fluid system for a pressure pump based on monitoring valves in the pressure pump using strain measurements. The pressure pump may be in fluid communication with an environment of a wellbore. The pressure pump may include a chamber on a fluid end of the pressure pump for receiving and discharging fluid of the fluid system for injecting the fluid into the wellbore. A suction valve in the chamber may be actuated to open and close to allow fluid to enter the chamber in response to the movement of a plunger in the chamber. A discharge valve in the chamber may be actuated to open and close to allow a discharge of fluid from the chamber in response to the movement of the plunger. As fluid is received and discharged from the chamber, strain in the fluid end fluctuates. A monitoring system may determine strain in the fluid end based on a strain signal. The strain signal may be generated by a strain gauge coupled to the fluid end of the pressure pump and may represent strain in the chamber. In some aspects, the monitoring system may determine actuation points representing the opening and closing of the suction and discharge valves in the chamber based on discontinuities in the strain signal. The monitoring system may correlate the strain measured by the strain gauge to the internal pressure in the pressure pump to determine the changes in pressure between the actuation points of the valves during operation of the pressure pump.

The bulk modulus of the fluid system may include the resistance of the fluid in the fluid system to uniform compression. In this manner, the multiplicative inverse of the bulk modulus may provide the fluid's compressibility, or the measure of the relative volume change of the fluid in response to a change in pressure. A monitoring system according to some aspects may determine the bulk modulus of the fluid system of the pressure pump by determining the bulk modulus of fluid isolated in a chamber of the pressure pump. Fluid may be briefly isolated in the chamber during an amount of time where both the suction valve and the discharge valve of the chamber are in a closed position. As the plunger continues to move within the chamber during this amount of time, the pressure may change in the chamber to allow the bulk modulus or compressibility of the fluid in the chamber to be determined by the monitoring system.

A monitoring system according to some aspects may allow the bulk modulus to be determined without breaching the external surface of the pressure pump. For example, the strain gauge may be positioned on the external surface of the fluid end of the pressure pump to measure and generate signals corresponding to the strain in the chamber. In this manner, an additional stress concentration is not added to the pressure pump in the form of a hole or other breach of the pressure pump to access an interior of the fluid end. Eliminating or not including additional stress concentration caused by a breach of the pressure pump may extend the fatigue life of the pressure pump.

Figure 1B:
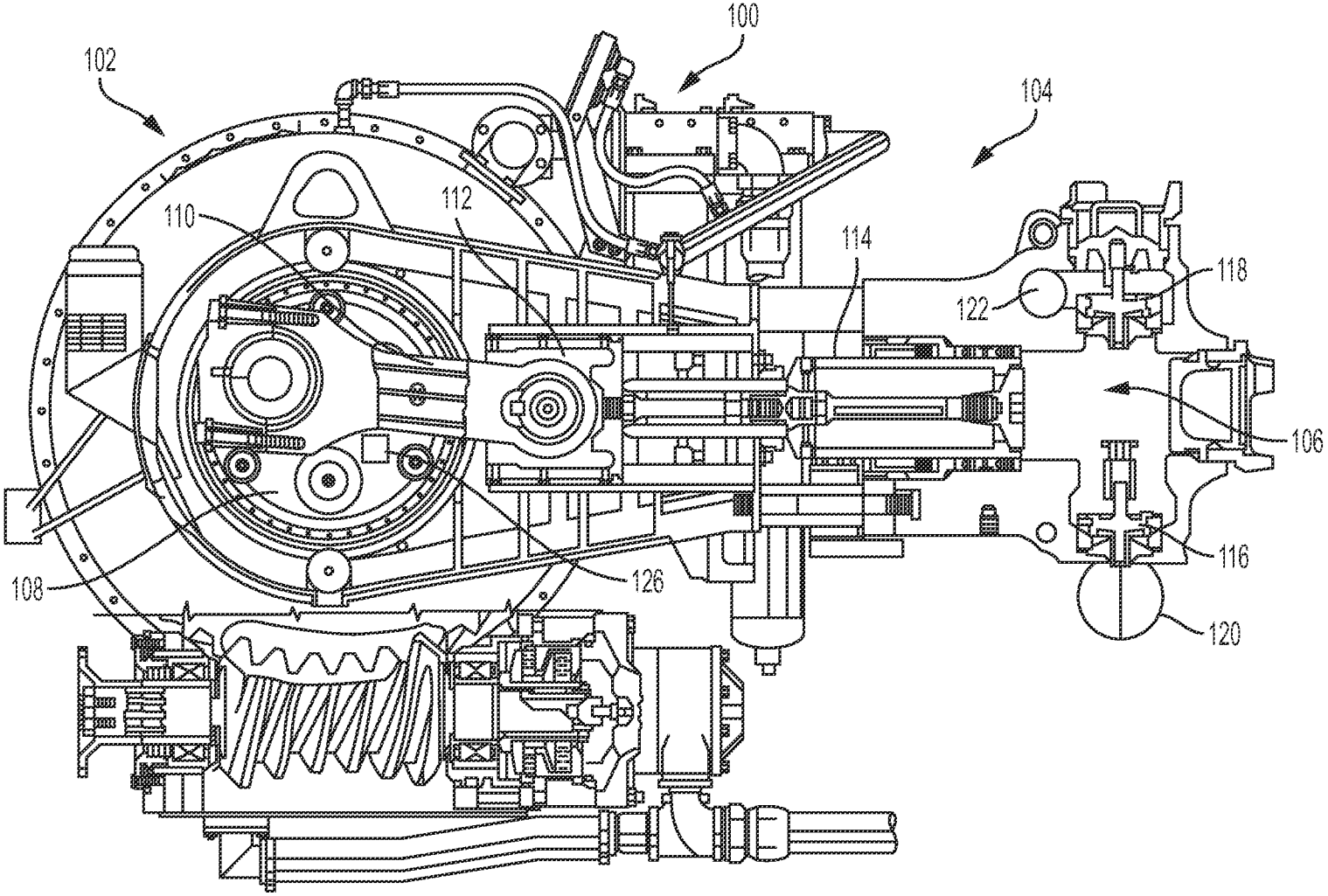
FIG. 1B is a cross-sectional, side view schematic diagram depicting the pressure pump of FIG. 1A according to one aspect of the present disclosure.

FIGS. 1A and 1B show a pressure pump 100 that may utilize a monitoring system according to some aspects of the present disclosure. The pressure pump 100 may be any positive displacement pressure pump. The pressure pump 100 may include a power end 102 and a fluid end 104. The power end 102 may be coupled to a motor, engine, or other prime mover for operation. The fluid end 104 includes chambers 106 for receiving and discharging fluid flowing through the pressure pump 100. Although FIG. 1A shows three chambers 106 in the pressure pump 100, the pressure pump 100 may include any number of chambers 106, including one, without departing from the scope of the present disclosure.

The pressure pump 100 may also include a rotating assembly. The rotating assembly may include a crankshaft 108, one or more connecting rods 110, a crosshead 112, plungers 114, and related elements (e.g., pony rods, clamps, etc.). The crankshaft 108 may be positioned in the power end 102 of the pressure pump 100 and may be mechanically connected to a plunger 114 in a chamber 106 of the pressure pump via the connecting rods 110 and the crosshead 112. The crankshaft 108 may cause a plunger 114 located in a chamber 106 to displace any fluid in the chamber 106. In some aspects, each chamber 106 of the pressure pump 100 may include a separate plunger 114, each plunger 114 in each chamber 106 mechanically connected to the crankshaft 108 via the connecting rod 110 and the crosshead 112. Each chamber 106 may include a suction valve 116 and a discharge valve 118 for absorbing fluid into the chamber 106 and discharging fluid from the chamber 106, respectively. The fluid may be absorbed into and discharged from the chamber 106 in response to a movement of the plunger 114 in the chamber 106. Based on the mechanical coupling of the crankshaft 108 to the plunger 114 in the chamber 106, the movement of the plunger 114 may be directly related to the movement of the crankshaft 108.

A suction valve 116 and a discharge valve 118 may be included in each chamber 106 of the pressure pump 100. In some aspects, the suction valve 116 and the discharge valve 118 may be passive valves. As the plunger 114 operates in the chamber 106, the plunger 114 may impart motion and pressure to the fluid by direct displacement. The suction valve 116 and the discharge valve 118 may open and close based on the displacement of the fluid in the chamber 106 by the plunger 114. For example, the suction valve 116 may be opened during a recession of the plunger 114 to provide absorption of fluid from outside of the chamber 106 into the chamber 106. As the plunger 114 is withdrawn from the chamber 106, a partial suction may be created to open the suction valve 116 to allow fluid to enter the chamber 106. In some aspects, the fluid may be absorbed into the chamber 106 from an inlet manifold 120. Fluid already in the chamber 106 may move to fill the space where the plunger 114 was located in the chamber 106. The discharge valve 118 may be closed during this process.

The discharge valve 118 may be opened as the plunger 114 moves forward, or reenters, the chamber 106. As the plunger 114 moves further into the chamber 106, the fluid may be pressurized. The suction valve 116 may be closed during this time to allow the pressure on the fluid to force the discharge valve 118 to open and discharge fluid from the chamber 106. In some aspects, the discharge valve 118 may discharge the fluid into a discharge manifold 122. The loss of pressure inside the chamber 106 may allow the discharge valve 118 to close and the cycle may restart. Together, the suction valve 116 and the discharge valve 118 may operate to provide the fluid flow in a desired direction. The process may include a measurable amount of pressure and stress in the chamber 106, the stress resulting in strain to the chamber 106 or fluid end 104 of the pressure pump 100. In some aspects, a monitoring system may be coupled to the pressure pump 100 to gauge the strain and determine a condition of the suction valve 116 and the discharge valve 118 in the chamber 106.

In some aspects, a monitoring system according to some aspects of the present disclosure may be coupled to the pressure pump 100 to gauge the strain and determine actuation of the suction valve 116 and the discharge valve 118 in the chamber 106. For example, a monitoring system may include strain gauges positioned on an external surface of the fluid end 104 to gauge strain in the chambers 106. Block 124 in FIG. 1A show an example placement for the strain gauges that may be included in the monitoring system. In some aspects, the monitoring system may include a separate strain gauge to monitor strain in each chamber 106 of the pressure pump 100.

In some aspects, a monitoring system according to some aspects may also include one or more position sensors for sensing the position of the crankshaft 108. Measurements of the crankshaft position may allow the monitoring system to determine the position of the plungers 114 in the respective chambers 106. A position sensor of the monitoring system may be positioned on an external surface of the pressure pump 100. Block 126 shows an example placement of a position sensor on an external surface of the power end 102 to sense the position of the crankshaft 108.

Figure 2:
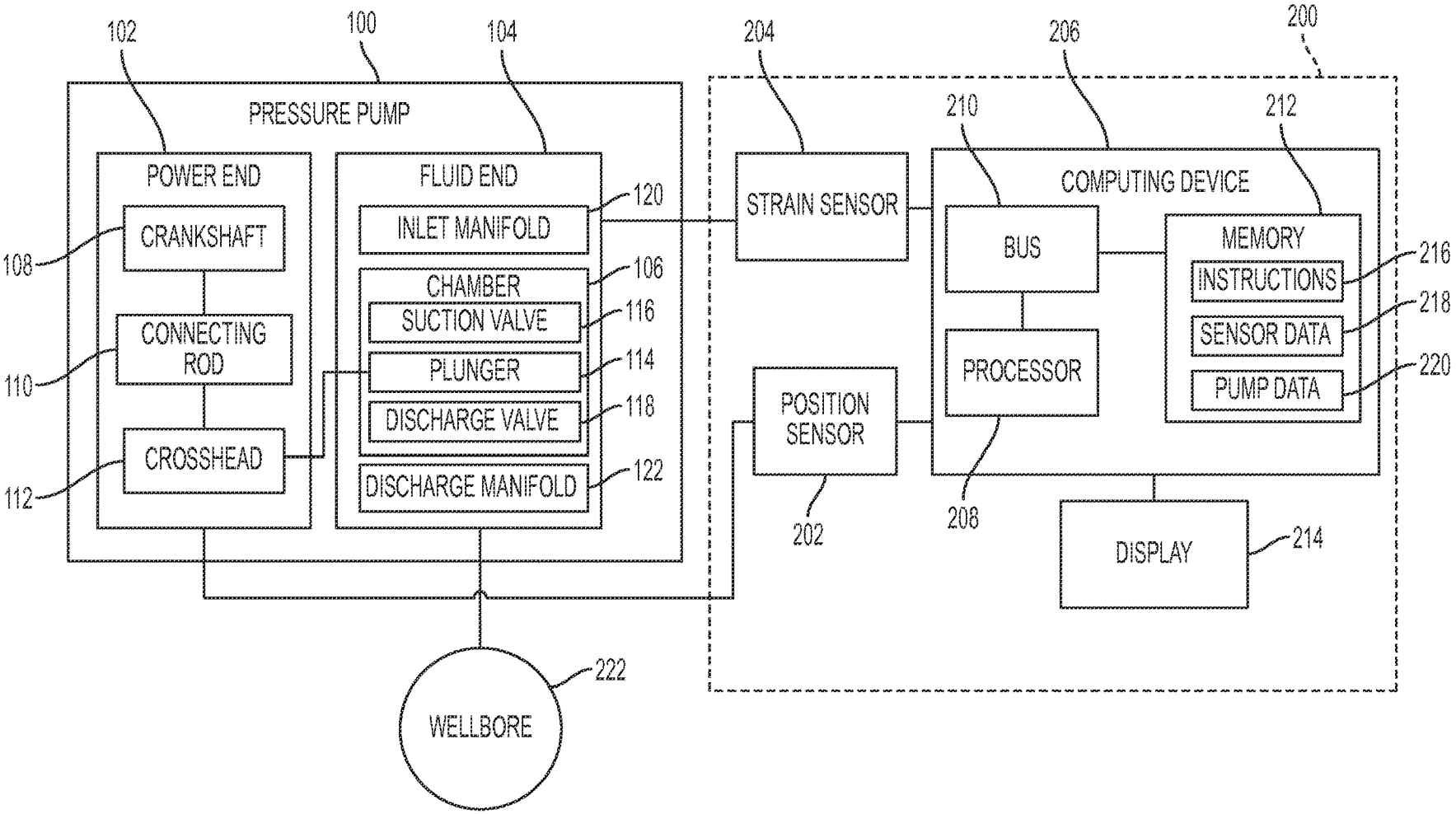
FIG. 2 is a block diagram depicting a monitoring system for a pressure pump according to one aspect of the present disclosure.

FIG. 2 is a simple block diagram showing an example of a monitoring system 200 coupled to the pressure pump 100. The monitoring system 200 may include a position sensor 202, a strain gauge 204, and a computing device 206. The position sensor 202 and the strain gauge 204 may be coupled to the pressure pump 100. The position sensor 202 may include a single sensor or may represent an array of sensors. The position sensor 202 may be a magnetic pickup sensor capable of detecting ferrous metals in close proximity. The position sensor 202 may be positioned on the power end 102 of the pressure pump 100 for determining the position of the crankshaft 108. In some aspects, the position sensor 202 may be placed proximate to a path of the crosshead 112. The path of the crosshead 112 may be directly related to a rotation of the crankshaft 108. The position sensor 202 may sense the position of the crankshaft 108 based on the movement of the crosshead 112. In other aspects, the position sensor 202 may be placed directly on a crankcase of the power end 102 as illustrated by block 126 in FIG. 1A. The position sensor 202 may determine a position of the crankshaft 108 by detecting a bolt pattern of the crankshaft 108 as it rotates during operation of the pressure pump 100. In each aspect, the position sensor 202 may generate a signal representing the position of the crankshaft 108 and transmit the signal to the computing device 206.

The strain gauge 204 may be positioned on the fluid end 104 of the pressure pump 100. The strain gauge 204 may include a single gauge or an array of gauges for determining strain in the chamber 106. Non-limiting examples of types of strain gauges may include electrical resistance strain gauges, semiconductor strain gauges, fiber optic strain gauges, micro-scale strain gauges, capacitive strain gauges, vibrating wire strain gauges, etc. In some aspects, the monitoring system 200 may include a strain gauge 204 for each chamber 106 of the pressure pump 100 to determine strain in each of the chambers 106, respectively. In some aspects, the strain gauge 204 may be positioned on an external surface of the fluid end 104 of the pressure pump 100 in a position subject to strain in response to stress in the chamber 106. For example, the strain gauge 204 may be positioned on a section of the fluid end 104 in a manner such that when the chamber 106 loads up, strain may be present at the location of the strain gauge 204. This location may be determined based on engineering estimations, finite element analysis, or by some other analysis. For example, finite element analysis may determine that strain in the chamber 106 may be directly over a plunger bore of the chamber 106 during load up. The strain gauge 204 may be placed on an external surface of the pressure pump 100 in a location directly over the plunger bore corresponding to the chamber 106 as illustrated by block 124 in FIG. 1A to measure strain in the chamber 106. The strain gauge 204 may generate a signal representing strain in the chamber 106 and transmit the signal to the computing device 206.

The computing device 206 may be coupled to the position sensor 202 and the strain gauge 204 to receive the generated signals from the position sensor 202 and the strain gauge 204. The computing device 206 may include a processor 208, a bus 210, and a memory 212. In some aspects, the monitoring system 200 may also include a display unit 214. The processor 208 may execute instructions 216 including one or more algorithms for determining a bulk modulus or other parameters in the pressure pump 100. The instructions 216 may be stored in the memory 212 coupled to the processor 208 by the bus 210 to allow the processor 208 to perform the operations. The processor 208 may include one processing device or multiple processing devices. Non-limiting examples of the processor 208 may include a Field-Programmable Gate Array ("FPGA"), an application-specific integrated circuit ("ASIC"), a microprocessor, etc. The non-volatile memory 212 may include any type of memory device that retains stored information when powered off Non-limiting examples of the memory 212 may include electrically erasable and programmable read-only memory ("EEPROM"), a flash memory, or any other type of non-volatile memory. In some examples, at least some of the memory 212 may include a medium from which the processor 208 can read the instructions 216. A computer-readable medium may include electronic, optical, magnetic or other storage devices capable of providing the processor 208 with computer-readable instructions or other program code (e.g., instructions 216). Non-limiting examples of a computer-readable medium include (but are not limited to) magnetic disks(s), memory chip(s), ROM, random-access memory ("RAM"), an ASIC, a configured processor, optical storage, or any other medium from which a computer processor can read the instructions 216. The instructions 216 may include processor-specific instructions generated by a compiler or an interpreter from code written in any suitable computer-programming language, including, for example, C, C++, C#, etc.

In some examples, the instructions 216 can include the following general equation for determining bulk modulus:

$$\beta = -\Delta P \frac{V_o}{\Delta V}$$

where β is the effective bulk modulus of the pressure pump 100 in psi (pounds per square inch), ΔP is the change in pressure in psi, $V_o$ is an initial volume of fluid, and ΔV is a change in the volume of fluid. The units of measurement for volume may not be significant to the equation as long as units associated with input values are consistent. The instructions 216 may also include the following equation for determining effective bulk modulus, representing the bulk modulus of each of the components of the pressure pump 100 associated with the chamber 106:

$$\frac{1}{\beta_e} = \frac{1}{\beta_1} + \frac{1}{\beta_2} + \frac{1}{\beta_3} \cdots$$

where $\beta_e$ is the effective bulk modulus in psi and the other terms ($\beta_1$, $\beta_2$, $\beta_3$, etc.) represent the additional components that affect the effective bulk modulus. The instructions 216 may also include the following equation for determining the bulk modulus of the fluid system components:

$$\frac{1}{\beta_{fluid}} = \frac{1}{\beta_e} - \frac{1}{\beta_{mechanical}}$$

where $\beta_{fluid}$ is the bulk modulus of the fluid system in psi, $\beta_e$ is the effective bulk modulus in psi, and $\beta_{mechanical}$ is the bulk modulus of the additional, non-fluid components associated with the chamber 106.

In some examples, the computing device 206 may determine an input for the instructions 216 based on sensor data 218 from the position sensor 202 or the strain gauge 204, data input into the computing device 206 by an operator, or other input means. For example, the position sensor 202 or the strain gauge 204 may measure a parameter associated with the pressure pump 100 (e.g., the position of the crankshaft 108, strain in the chamber 106) and transmit associated signals to the computing device 206. The computing device 206 may receive the signals, extract data from the signals, and store the sensor data 218 in memory 212. In additional aspects, the computing device 206 may determine an input for the instructions 216 based on pump data 220 stored in the memory 212 in response to previous determinations by the computing device 206. For example, the processor 208 may execute instructions 216 for determining bulk modulus and may store the determinations, and intermediate determinations (e.g., internal pressure determinations) as pump data 220 in the memory 212 for further use in pumping and monitoring operations (e.g., calibrating the pressure pump, determining conditions in the pressure pump, comparing changes in bulk modulus, determining expected valve actuation delays, etc.).

In some aspects, the computing device 206 may generate graphical interfaces associated with the sensor data 218 or pump data 220, and information generated by the processor 208 therefrom, to be displayed via a display unit 214. The display unit 214 may be coupled to the processor 208 and may include any CRT, LCD, OLED, or other device for displaying interfaces generated by the processor 208. In some aspects, the computing device 206 may also generate an alert or other communication of the performance of the pressure pump 100 based on determinations by the computing device 206 in addition to, or instead of, the graphical interfaces. For example, the display unit 214 may include audio components to emit an audible signal when a condition is present in the pressure pump 100.

In some aspects, in addition to the monitoring system 200, the pressure pump 100 may also be coupled to (e.g., in fluid communication with) a wellbore 222. For example, the pressure pump 100 may be used in hydraulic fracturing to inject fluid into the wellbore 222. Subsequent to the fluid passing through the chambers 106 of the pressure pump 100, the fluid may be injected into the wellbore 222 at a high pressure to break apart or otherwise fracture rocks and other formations in the wellbore 222 to release hydrocarbons. The monitoring system 200 may monitor the suction valve 116 and the discharge valve 118 to determine when to halt the fracturing process for maintenance of the pressure pump 100. Although hydraulic fracturing is described here, the pressure pump 100 may be used for any process or environment requiring a positive displacement pressure pump.

Figure 3:
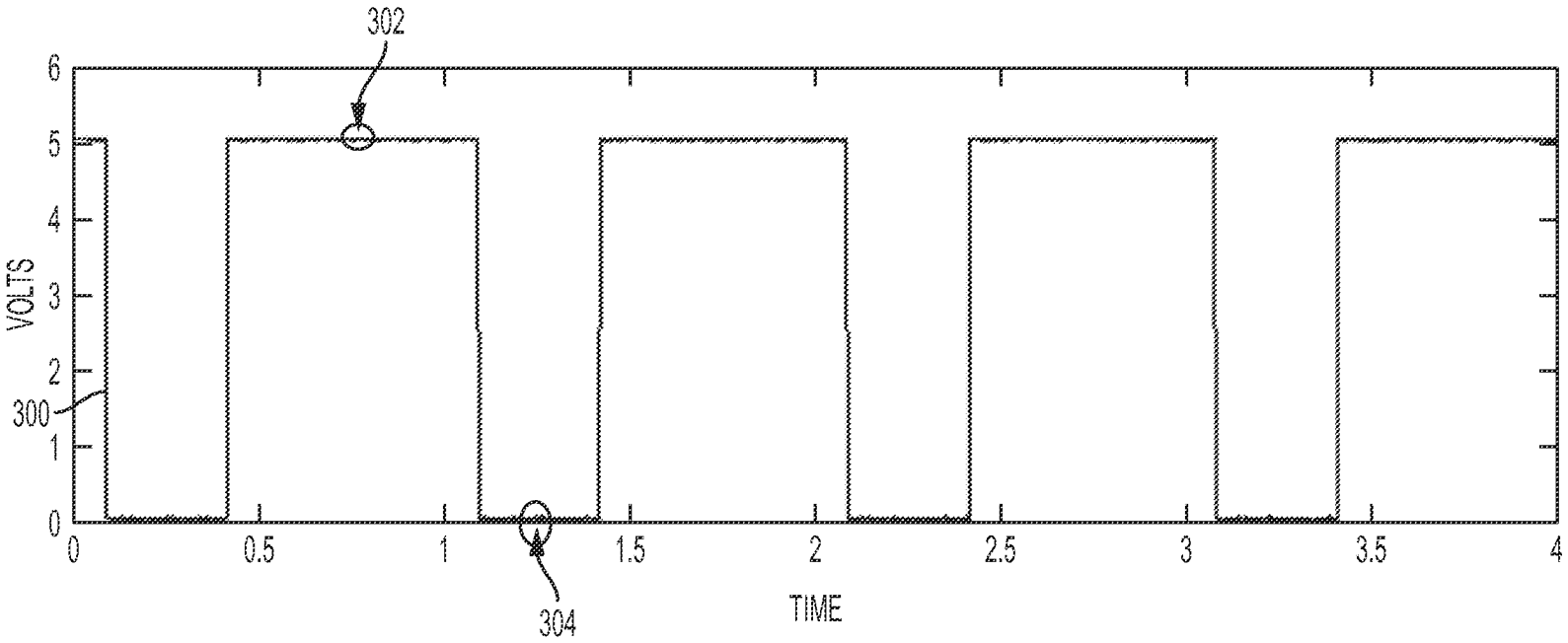
FIG. 3 is a signal graph depicting a signal generated by a position sensor of the monitoring system of FIG. 2 according to one aspect of the present disclosure.
Figure 4:
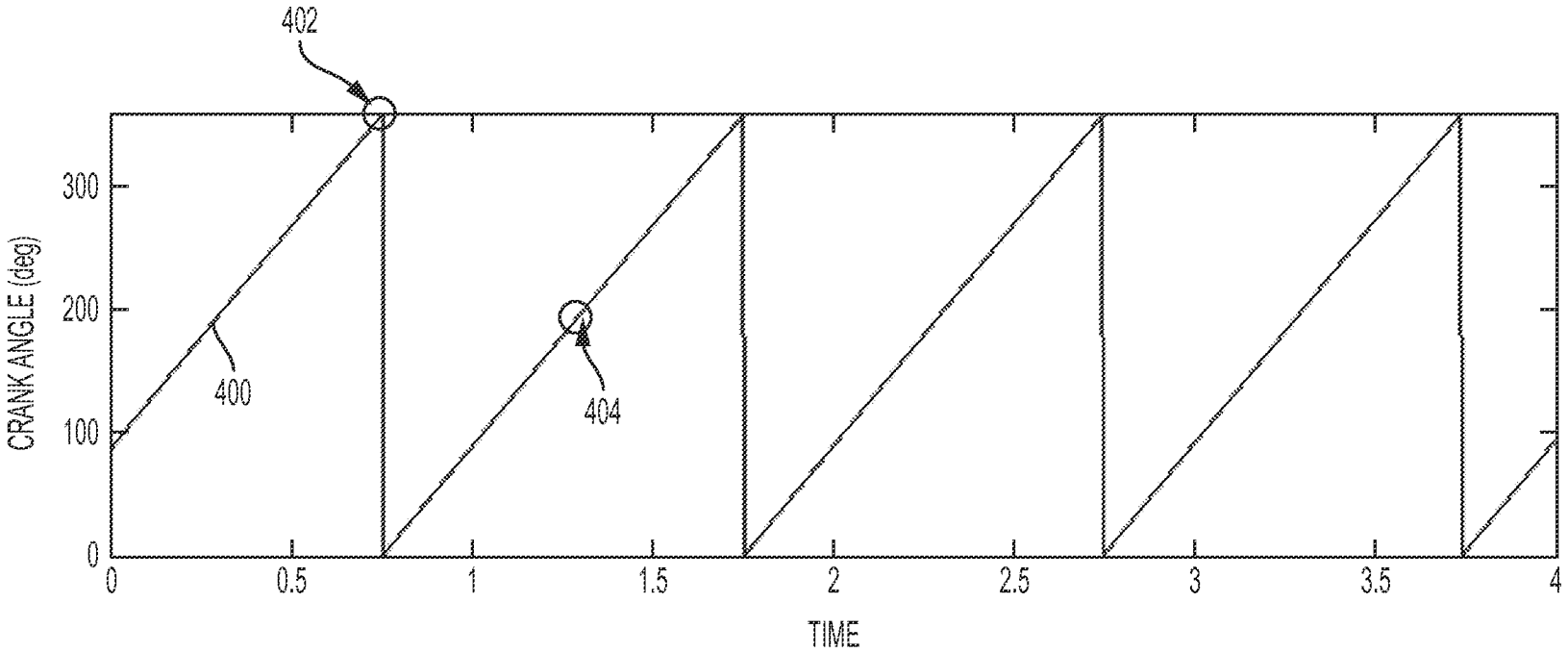
FIG. 4 is a signal graph depicting an alternative signal generated by a position sensor of the monitoring system of FIG. 2 according to one aspect of the present disclosure.

FIGS. 3 and 4 show position signals 300, 400 generated by the position sensor 202 during operation of the crankshaft 108. In some aspects, the position signals 300, 400 may be shown on the display unit 214 in response to generation of graphical representation of the position signals 300, 400 by the computing device 206. FIG. 3 shows a position signal 300 displayed in volts over time (in seconds). The position signal 300 may be generated by the position sensor 202 coupled to the power end 102 of the pressure pump 100 and positioned in a path of the crosshead 112. The position signal 300 may represent the position of the crankshaft 108 over the indicated time as the crankshaft 108 operates to cause the plunger 114 to move in the chamber 106. The mechanical coupling of the plunger 114 to the crankshaft 108 may allow the computing device 206 to determine a position of the plunger 114 relative to the position of the crankshaft 108 based on the position signal 300. In some aspects, the computing device 206 may determine plunger position reference points 302, 304, 402, 404 based on the position signal 300 generated by the position sensor 202. For example, the processor 208 may determine dead center positions of the plunger 114 based on the position signal 300. The dead center positions may include the position of the plunger 114 in which it is farthest from the crankshaft 108, known as the top dead center. The dead center positions may also include the position of the plunger 114 in which it is nearest to the crankshaft 108, known as the bottom dead center. The distance between the top dead center and the bottom dead center may represent the length of a full stroke of the plunger 114 operating in the chamber 106.

In FIG. 3, the top dead center is represented by reference point 302 and the bottom dead center is represented by reference point 304. In some aspects, the processor 208 may determine the reference points 302, 304 by correlating the position signal 300 with a known ratio or other value representing the relationship between the movement of the crankshaft 108 and the movement of the plunger 114 (e.g., the mechanical correlations of the crankshaft 108 to the plunger 114 based on the mechanical coupling of the crankshaft 108 to the plunger 114 in the pressure pump 100). The computing device 206 may determine the top dead center and bottom dead center based on the position signal 300 or may determine other plunger position reference points to determine the position of the plunger over the operation time of the pressure pump 100.

FIG. 4 shows a position signal 400 displayed in degrees over time (in seconds). The degree value may represent the rotational angle of the crankshaft 108 during operation of the crankshaft 108 or pressure pump 100. In some aspects, the position signal 400 may be generated by the position sensor 202 located directly on the power end 102. The position sensor 202 may generate the position signal 400 based on the bolt pattern of the crankshaft 108 as it rotates in response to the rotation of the crankshaft 108 during operation. Similar to the position signal 300 shown in FIG. 3, the computing device 206 may determine plunger position reference points 302, 304, 402, 404 based on the position signal 400. The reference points 402, 404 in FIG. 4 represent the top dead center and bottom dead center of the plunger 114 for the chamber 106 during operation of the pressure pump 100.

Figure 5:
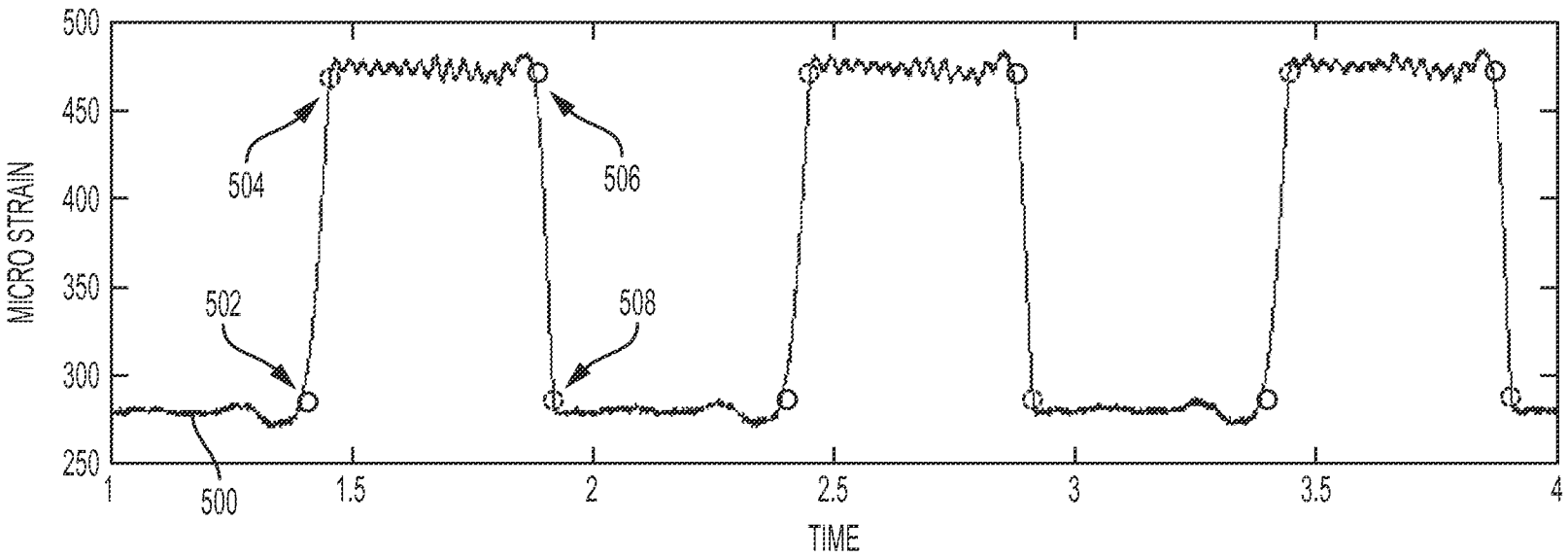
FIG. 5 is a signal graph depicting a signal generated by a strain gauge of the monitoring system of FIG. 2 according to one aspect of the present disclosure.

FIG. 5 shows a raw strain signal 500 generated by the strain gauge 204 coupled to the fluid end 104 of the pressure pump 100 and positioned on an external surface of the fluid end 104. The strain signal 500 may represent strain measured by the strain gauge 204 in the chamber 106 of the pressure pump 100. The computing device 206 may determine the actuation points 502, 504, 506, 508 of the suction valve 116 and the discharge valve 118 for the chamber 106 based on the strain signal 500. The actuation points 502, 504, 506, 508 may represent the point in time where the suction valve 116 and the discharge valve 118 open and close. The computing device 206 may execute the instructions 216 stored in the memory 212 and including signal-processing algorithms to determine the actuation points 502, 504, 506, 508. For example, the computing device 206 may execute instructions 216 to determine the actuation points 502, 504, 506, 508 by determining discontinuities in the strain signal 500. The stress in the chamber 106 may change during the operation of the suction valve 116 and the discharge valve 118 to cause the discontinuities in the strain signal 500 during actuation of the valves 116, 118 and the computing device 206 may identify the discontinuities as the opening and closing of the valves 116, 118. In one example, the strain in the chamber 106 may be isolated to the fluid in the chamber 106 when the suction valve 116 is closed. The isolation of the strain may cause the strain in the chamber 106 to load up until the discharge valve 118 is opened. When the discharge valve 118 is opened, the strain may level until the discharge valve 118 is closed, at which point the strain may unload until the suction valve 116 is reopened. The discontinuities may be present when the strain signal 500 shows a sudden increase or decrease in value corresponding to the actuation of the valves 116, 118.

In FIG. 5, actuation point 502 represents the suction valve 116 closing, actuation point 504 represents the discharge valve 118 opening, actuation point 506 represents the discharge valve 118 closing, and actuation point 508 represents the suction valve 116 opening to resume the cycle of fluid into and out of the chamber 106. In some aspects, the computing device 206 may cause the display unit 214 to display the strain signal 500 and the actuation points 502, 504, 506, 508 as shown in FIG. 5. The computing device 206 may determine the actuation points 502, 504, 506, 508 based on the strain signal 500 providing a characterization of the loading and unloading of the strain in the chamber 106.

The portion of the strain signal measured by the strain gauge 204 during times where both of the suction valve 116 and the discharge valve 118 are in a closed position may be used by the computing device 206 to determine the bulk modulus of fluid in the chamber 106. For example, the portion of the strain signal between actuation point 502 representing the closing of the suction valve 116 and actuation point 504 representing the opening of the discharge valve 118 may correspond to the strain in the chamber 106 over an amount of time when both the suction valve 116 and the discharge valve 118 are closed to isolate fluid in the chamber 106. As shown by the ramping up of the strain signal during the amount of time between the actuation points 502, 504 corresponds to a ramping up of the strain and pressure in the pump as the plunger 114 continues to move in the chamber during this time. Since the fluid is isolated in the chamber during this time, the movement of the plunger 114 may serve to temporarily compress or pressurize the fluid in the chamber 106 by displacing the fluid in the chamber 106 to cause a ramp up of the pressure.

Figure 6:
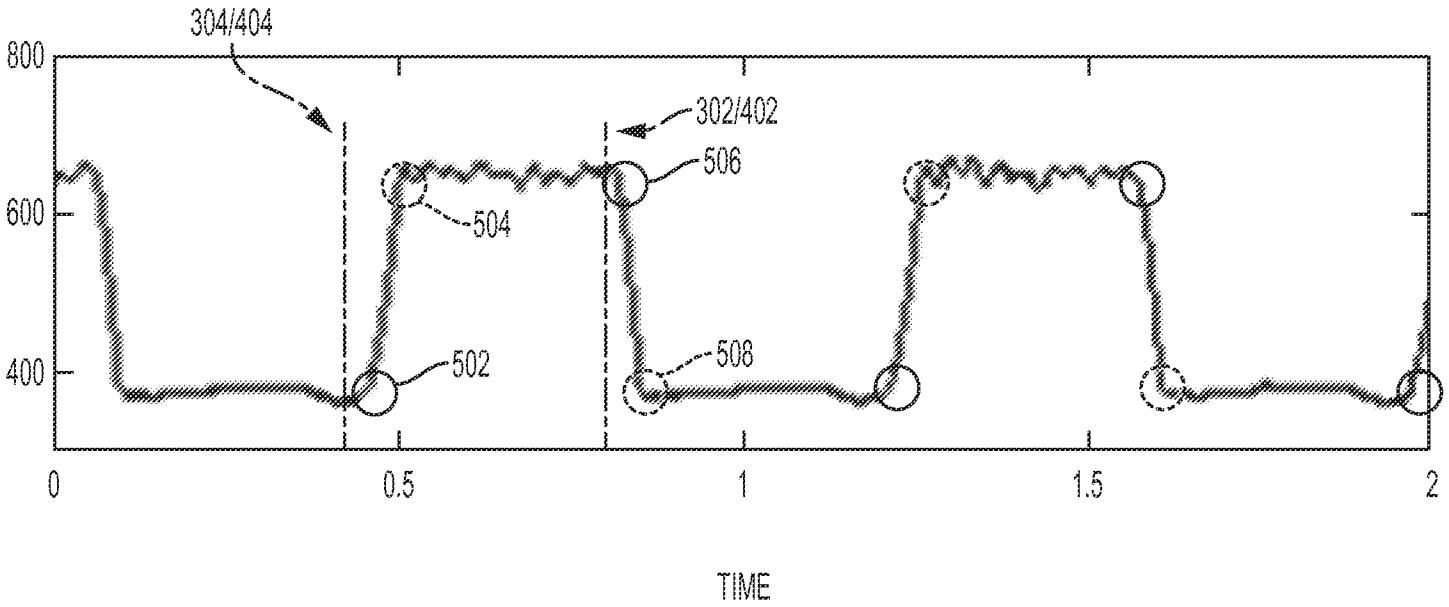
FIG. 6 is a signal graph depicting actuation of a suction valve and a discharge valve relative to the strain signal of FIG. 5 and a plunger position according to one aspect of the present disclosure.

In some aspects, the actuation points 502, 504, 506, 508 may be cross-referenced with the position signals 300, 400 to determine the position and movement of the plunger 114 in reference to the actuation of the suction valve 116 and the discharge valve 118. FIG. 6 shows the actuation of the suction valve 116 and the discharge valve 118 relative to the plunger position reference points 302, 304, 402, 404. In some aspects, the graphs depicted in FIG. 6 may be displayed on the display unit 214. The amount of time between the actuation points 502, 504, 506, 508 and the plunger position reference points 302, 304, 402, 404 may represent delays in the actuation (e.g., opening and closing) of the suction valve 116 and the discharge valve 118 that may temporarily isolate the fluid when both the suction valve 116 and the discharge valve are closed.

FIG. 6 shows the strain signal 500. The actuation points 502, 504, 506, 508 of the suction valve 116 and the discharge valve 118 are plotted at the discontinuities in the strain signal 500 as described with respect to FIG. 5. Additionally, the reference points 302, 304, 402, 404 representing the top dead center and bottom dead center of the plunger 114 are plotted. The time between the closing of the suction valve 116 (represented by actuation point 502) and the bottom dead center (represented by reference points 304, 404) may represent a delay in the closing of the suction valve 116. The time between the opening of the discharge valve 118 (represented by actuation point 504) and the bottom dead center (represented by reference points 304, 404) may represent a delay in the opening of the discharge valve 118. Similarly, the time between the closing of the discharge valve 118 (represented by actuation point 504) and the top dead center (represented by reference points 302, 402) may represent a delay in the closing of the discharge valve 118. And, the amount of time between the opening of the suction valve 116 (represented by actuation point 508) and the top dead center (represented by reference points 302, 402) may represent a delay in the opening of the suction valve 116. The monitoring system 200 may correlate the movement of the plunger 114 with the times at and between the actuation points 502, 504 to determine a volume of fluid in the chamber 106 at the actuation point 502 and the displacement of fluid in the chamber by the movement of the plunger 114 during the time between the actuation points 502, 504. In some aspects, the volume of the displaced fluid may correspond to a change in volume of the fluid for purposes of determining the bulk modulus of the pressure pump.

Figure 7:
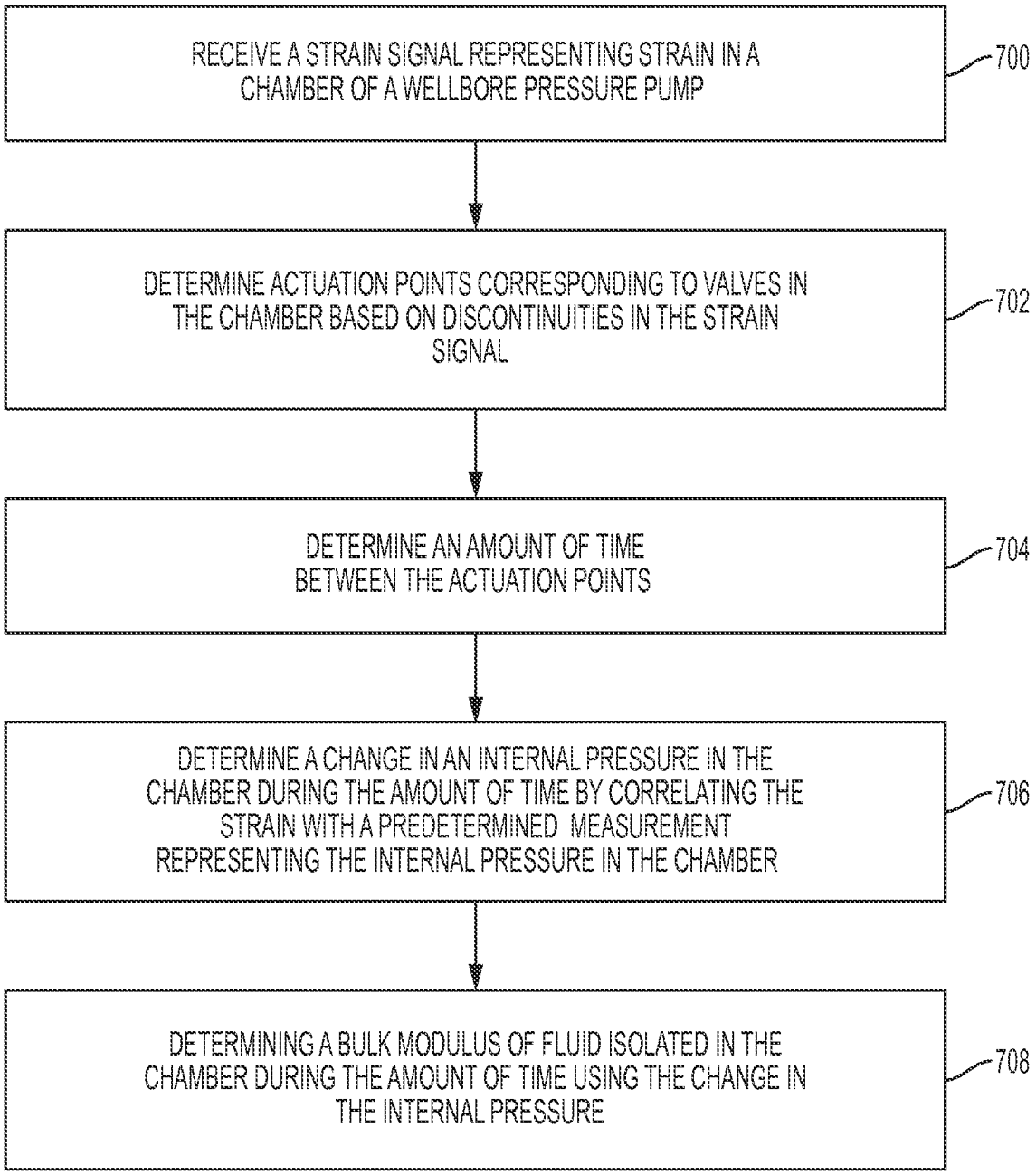
FIG. 7 is a flowchart describing an example of a process for determining a bulk modulus of a fluid system of the pressure pump according to one aspect of the present disclosure.

FIG. 7 is a flowchart showing a process for monitoring the suction valve 116 or the discharge valve 118 to determine a bulk modulus of the fluid system of the pressure pump 100. The process is described with respect to the monitoring system 200 shown in FIG. 2, although other implementations are possible without departing from the scope of the present disclosure.

In block 700, the computing device 206 may receive the strain signal 500 from the strain gauge 204. The strain gauge 204 may be positioned on the fluid end 104 of the pressure pump 100 and generate the strain signal 500 corresponding to strain in the chamber 106 of the pressure pump 100. The strain signal 500 may represent the strain in the chamber 106 as the suction valve 116 and the discharge valve 118 actuate (e.g., open or close) in response to the operation of the plunger 114 in the chamber 106.

In block 702, the computing device 206 may determine the actuation points 502, 504 for the suction valve 116 and the discharge valve 118, respectively. In some aspects, the computing device 206 may determine actuation points 502, 504 based on the discontinuities in the strain signal 500 as described with respect to FIG. 5. The actuation point 502 may represent the closing of the suction valve 116. The actuation point 504 may represent the opening of the discharge valve 118. For illustrative purposes, the remaining steps in the process described in FIG. 7 are with respect to the actuation points 502, 504. But, in additional and alternative aspects, the computing device 206 may similarly determine actuation points 506, 508 representing the closing of the discharge valve 118 and the opening of the suction valve 116, respectively. In such aspects, the computing device 206 may continue the process of determining the bulk modulus of the fluid system of the pressure pump 100 as described herein based on the actuation points 506, 508 or other actuation points defining a boundary of an amount of time wherein both the suction valve 116 and the discharge valve 118 are closed to isolate the fluid in the chamber 106.

In block 704, the computing device 206 may determine the amount of time between the actuation points 502, 504 for the suction valve 116 and the discharge valve. The amount of time between the actuation points 502, 504 may represent the amount of time that fluid is isolated in the chamber 106 in response to both the suction valve 116 and the discharge valve 118 being closed. The computing device 206 may determine the amount of time between the actuation points 502, 504 from the strain signal 500 by identifying the amount of time between the discontinuities of the strain signal 500 where the strain measured by the strain gauge 204 ramps up in response to the isolation of the fluid.

In block 706, the computing device 206 may determine the change in internal pressure in the chamber during the amount of time between the actuation points 502, 504. In some aspects, the computing device 206 may correlate the strain in the chamber 106 with a known internal pressure to determine the change in internal pressure during the amount of time between the actuation points 502, 504. The known internal pressure may be previously determined based on engineering estimations, testing, experimentation, or calculations and previously stored as pump data 220 in the memory 212. For example, the known internal pressure may be estimated using finite element analysis. Finite element analysis may be performed to predict how the pressure pump 100 may respond or react to real-world forces. An operator may input or store pump properties concerning the pressure pump 100 and the fluid system properties concerning the fluid flowing through the pressure pump 100 in the memory 212 of the computing device as pump data 220. The computing device 206 may perform finite element analysis to generate a finite element model representing the pressure pump 100 based on the input pump data 220.

Figure 8:
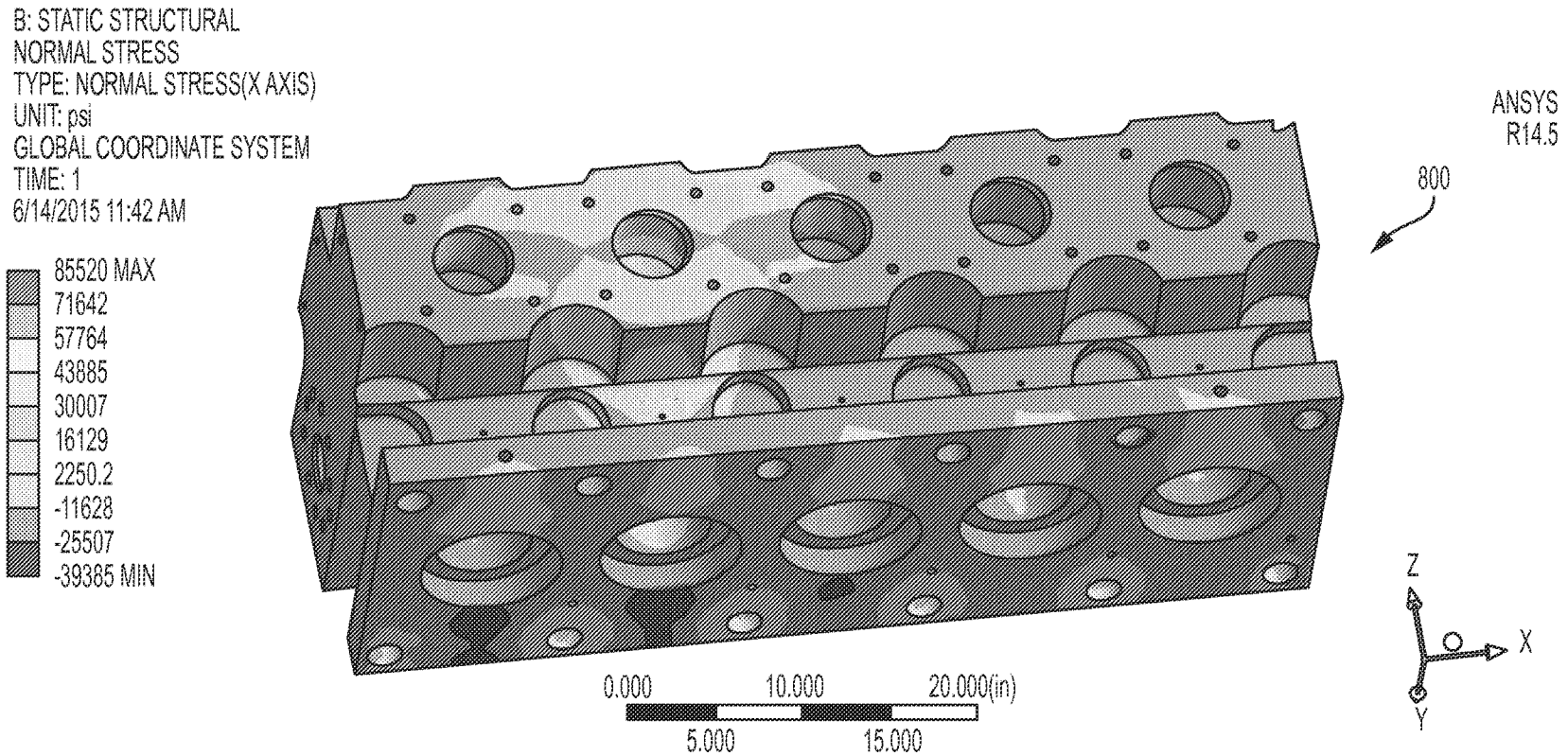
FIG. 8 is a finite element model that may be used to correlate the strain signal of FIG. 5 to internal pressure in a pressure pump according to one aspect of the present disclosure.

FIG. 8 shows an example of a finite element model 800 that may represent the pressure pump 100. The finite element model 800 may simulate the operation of the pressure pump 100 in the conditions derived from the pump properties and the fluid system properties input as pump data 220 to estimate the known internal pressure. The computing device 206 may determine the change in internal pressure during the amount of time between the actuation points 502, 504 by correlating the strain signal 500 during the amount of time between the actuation points 502, 504 (representing the change in strain in the chamber 106 during the amount of time between the actuation points 502, 504) with the determined measurement representing the known internal pressure.

Referring back to FIG. 7, in block 708, the computing device 206 may determine the bulk modulus of the fluid isolated in the chamber 106 during the amount of time between the actuation points 502, 504. In some aspects, the processor 208 may execute instructions 216 to cause the computing device 206 to determine the bulk modulus of the fluid in the chamber 106 by determining the effective bulk modulus associated with components of the chamber 106. The effective bulk modulus may be determined by multiplying an additive inverse of the change in the internal pressure in the chamber during the amount of time between the actuation points 502, 504 with an initial volume of the fluid in the chamber 106 when the suction valve 116 closes (e.g., at actuation point 502) and the change in the volume of the fluid in the chamber 106 during the amount of time between the actuation points 502, 504. In some aspects, the computing device may determine the volume in the chamber 106 and the change in volume between the actuation points 502, 504 by correlating the movement of the plunger 114 with the amount of time between the actuation points 502, 504 to identify the volume of fluid displaced by the plunger 114 in the chamber 106 during that time as described with respect to FIG. 6. The volume of the displaced fluid may correspond to a change in volume of the fluid for purposes of determining the bulk modulus of the pressure pump. In other aspects, the volume of fluid in the chamber 106 and the change of volume in the chamber during the amount of time between the actuation points 502, 504 may be known or previously determined values stored in the memory 212 as pump data 220 and used as input by the computing device 206 in executing the instructions 216 to determine the bulk modulus.

Figure 9:
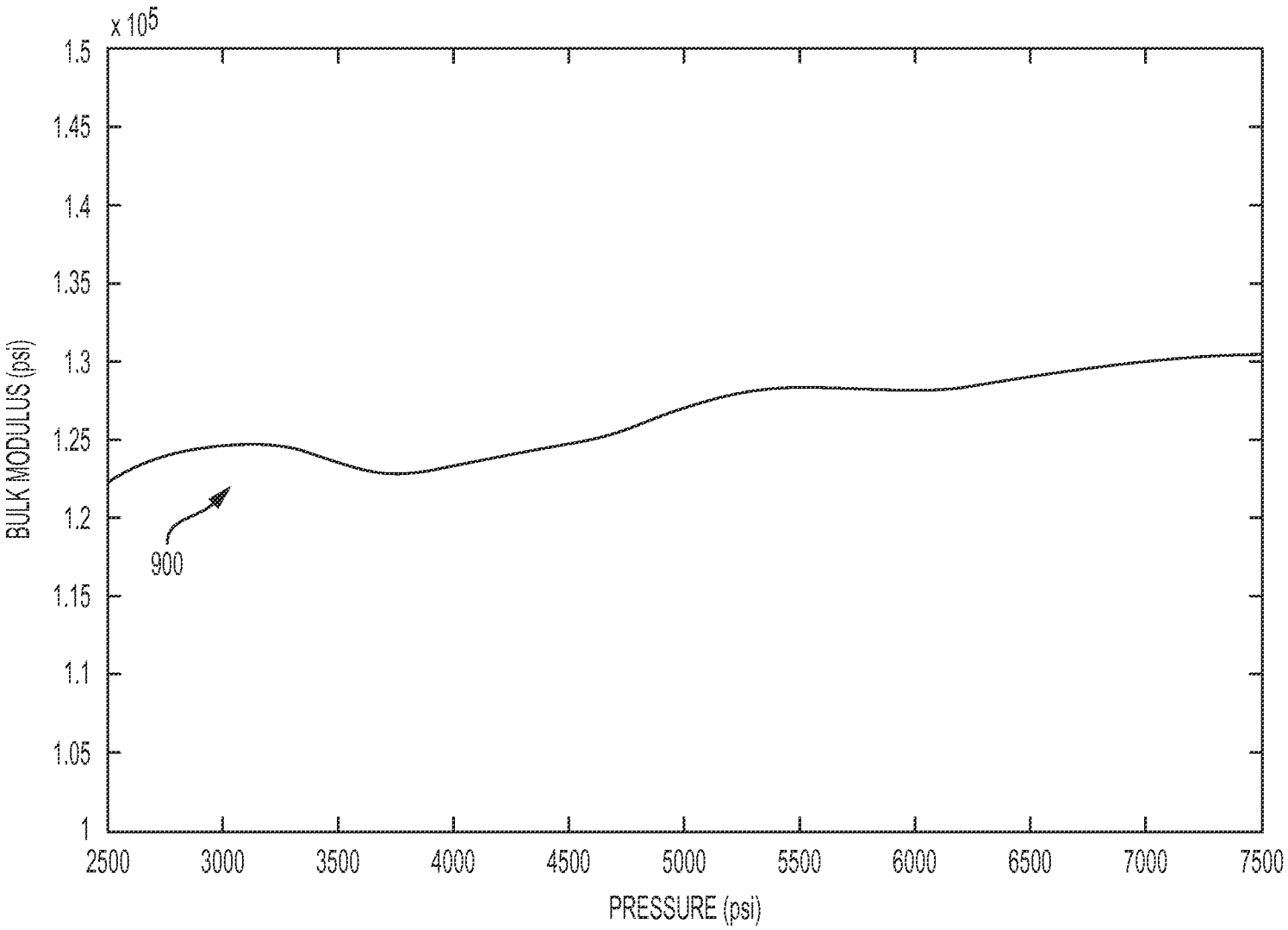
FIG. 9 is a signal graph depicting an example of a bulk modulus reading generated by the monitoring system of FIG. 2 according to one aspect of the present disclosure.

The effective bulk modulus may include the effects of the pressure pump 100 and components of the pressure pump 100 (e.g., packing, valve inserts, etc.) in addition to the fluid system. FIG. 9 shows an effective bulk modulus reading 900 that may be generated by the computing device 206. The bulk modulus may be determined by the computing device 206 during the amount of time between the actuation points 502, 504. Accordingly, the effective bulk modulus reading 900 may include a continuous curve of bulk modulus ranging from the inlet pressure corresponding to the suction side of the pressure pump 100 (and the suction valve 116 of the chamber 106) to the outlet pressure corresponding to the discharge side of the pressure pump 100 (and the discharge valve 118 of the chamber 106).

In some aspects, the non-fluid components may be combined to determine a mechanical bulk modulus that may be removed from the effective bulk modulus to determine the bulk modulus of the fluid system. In some aspects, the computing device 206 may determine the mechanical bulk modulus by engineering estimations, analysis, and calculations or by testing a known fluid having a known bulk modulus. For example, the computing device 206 may remove the known bulk modulus of a fluid such as water from the effective bulk modulus to determine the mechanical bulk modulus of the non-fluid components of the pressure pump 100 or chamber 106. Assuming that the mechanical bulk modulus remains consistent by the introduction of the fluid system, the computing device 206 may determine the bulk modulus of the fluid isolated in the chamber 106 by removing the mechanical bulk modulus of the non-fluid components from the effective bulk modulus by executing instructions 216 in the memory 212. The bulk modulus of the fluid isolated in the chamber 106 may represent the bulk modulus of the entire fluid system of the pressure pump 100. Since the effective bulk modulus reading 900 may include a continuous curve ranging from the inlet pressure to the outlet pressure, the bulk modulus of the fluid may also include a continuous curve of bulk modulus ranging from the inlet pressure corresponding to the suction side of the pressure pump 100 to the outlet pressure corresponding to the discharge side of the pressure pump 100. In some aspects, the continuous curve of bulk modulus may be extrapolated further to determine the bulk modulus of the fluid system at various pressures, including downhole conditions of the wellbore 222 to accurately conduct displacements (e.g., cement, ball drops, etc.).

In some aspects, the monitoring system 200 may confirm that the fluid in the chamber 106 is isolated during the amount of time between the actuation points 502, 504 by monitoring the actuation delays of the valve to determine the condition of the pressure pump 100. Conditions in the chamber such as leaks may affect the isolation of the fluid during the amount of time between the actuation points 502, 504. This may consequently affect the accuracy of the bulk modulus of the fluid system determined by the computing device 206. In one example, the computing device 206 may determine whether a leak or other condition that may affect the accuracy of the bulk modulus determinations based on the position of the plunger 114 and the actuation points 502, 504, 506, 508 for the suction valve 116 and discharge valve 118. The computing device 206 may correlate the reference points 302/402, 304/404 corresponding to the position of the plunger 114 and derived from the position signal 300/400 with the actuation points 502, 504, 506, 508 corresponding to the actuation of the suction valve 116 and discharge valve 118. The time between the reference point 304/404 of the position of the plunger 114 and the actuation points 502, 504 may represent the delays in the closing of the suction valve 116 and opening of the discharge valve 118, respectively. Similarly, the time between the reference point 302/402 of the position of the plunger 114 and the actuation points 506, 508 may represent the delays in the closing of the discharge valve 118 and the opening of the suction valve 116, respectively. In some aspects, the delays may be compared with known or expected actuation delays for the suction valve 116 and the discharge valve 118 to determine whether a leak or other condition exists that may affect the isolation of the fluid during the amount of time between the actuation points 502, 504.

In some aspects, pumping systems are provided according to one or more of the following examples:

EXAMPLE #1

A monitoring system for a pump may comprise a strain gauge positionable on a fluid end of the pump to measure strain in a chamber of the pump and generate a strain signal representing the strain in the chamber. The strain signal may be useable in determining actuation points for valves in the chamber. The monitoring system may also comprise a computing device couplable to the strain gauge. The computing device may include a processing device for which instructions executable by the processing device are used to cause the processing device to determine a bulk modulus of fluid isolated in the chamber during an amount of time between the actuation points for the valves.

EXAMPLE #2

The monitoring system of Example #1 may feature the computing device comprising a memory device including instructions executable by the processing device for causing the processing device to determine the actuation points for the valves in the chamber by identifying discontinuities in the strain signal. The valves may include a first valve and a second valve. The actuation points may include a first point corresponding to a closing of the first valve and a second point corresponding to an opening of the second valve.

EXAMPLE #3

The monitoring system of Examples #1-2 may feature the computing device comprising a memory device including instructions executable by the processing device for causing the processing device to correlate a portion of the strain signal between the actuation points with an internal pressure in the chamber to determine a change in the internal pressure during the amount of time between the actuation points for the valves.

EXAMPLE #4

The monitoring system of Examples #1-3 may feature the computing device comprising a memory device including instructions executable by the processing device for causing the processing device to correlate the strain signal with an internal pressure in the chamber using finite element analysis of the pump to generate a reading representing the internal pressure in the chamber.

EXAMPLE #5

The monitoring system of Examples #1-4 may feature the computing device comprising a memory device including instructions executable by the processing device for causing the processing device to determine an effective bulk modulus of the pump using an internal pressure change in the chamber during the amount of time between the actuation points, a fluid volume in the chamber at one of the actuation points, and a change in the fluid volume during the amount of time between the actuation points. The effective bulk modulus may include the bulk modulus of the fluid and a mechanical bulk modulus of non-fluid components of the pump.

EXAMPLE #6

The monitoring system of Examples #1-5 may also include a position sensor positionable on a power end of the pump to sense a position of a member of a rotating assembly of the pump and generate a position signal representing the position of the member during operation of the pump. The position signal may be usable in determining a movement of a displacement member in the chamber. The computing device may comprise a memory device including instructions executable by the processing device for causing the processing device to determine the change in the fluid volume using a volume of the fluid in the chamber displaced by the movement of the displacement member during the amount of time between the actuation points for the valves.

EXAMPLE #7

The monitoring system of Examples #1-6 may feature the memory device comprising instructions executable by the processing device for causing the processing device to determine the movement of the displacement member by correlating the position of the member of the rotating assembly with a ratio representing a mechanical correlation of the displacement member to the member of the rotating assembly.

EXAMPLE #8

The monitoring system of Examples #1-7 may feature the computing device comprising a memory device including instructions executable by the processing device for causing the processing device to determine the bulk modulus of the fluid by determining a mechanical bulk modulus of non-fluid components of the pump by removing a first reciprocal of a known bulk modulus of a test fluid from a second reciprocal of an effective bulk modulus of the pump and removing a third reciprocal of the mechanical bulk modulus of the non-fluid components of the pump from the second reciprocal.

EXAMPLE #9

The monitoring system of Examples #1-8 may the strain gauge being positionable on an external surface of the fluid end of the pump to measure the strain in the chamber.

EXAMPLE #10

A pumping system may comprise a pump including a fluid end and a power end. The fluid end of the pump may include a chamber having a first valve actuatable to a closed position at a first actuation point and a second valve actuatable to an open position at a second actuation point. An amount of time between the first actuation point and the second actuation point may be detectable by a strain gauge. The pumping system may also comprise a computing device couplable to the pump. The computing device may include a processing device for which instructions executable by the processing device are used to cause the processing device to determine a bulk modulus of fluid isolated in the chamber during the amount of time between the first actuation point and the second actuation point.

EXAMPLE #11

The pumping system of Example #10 may feature the computing device comprising a memory device including instructions executable by the processing device for causing the processing device to determine the first actuation point and the second actuation point by identifying discontinuities in a strain signal received from the strain gauge and representing strain in the chamber.

EXAMPLE #12

The pumping system of Examples #10-11 may feature the computing device comprising a memory device including instructions executable by the processing device for causing the processing device to receive a strain signal from the strain gauge representing strain in the chamber and to determine a change in an internal pressure in the chamber during the amount of time between the first actuation point and the second actuation point by correlating a portion of the strain signal between the first actuation point and the second actuation point with the internal pressure in the chamber.

EXAMPLE #13

The pumping system of Examples #10-12 may feature the computing device comprising a memory device including instructions executable by the processing device for causing the processing device to receive a strain signal from the strain gauge representing strain in the chamber and to correlate the strain signal with an internal pressure in the chamber using finite element analysis of the pump to generate a reading representing the internal pressure in the chamber.

EXAMPLE #14

The pumping system of Examples #10-13 may feature the computing device comprising a memory device having instructions executable by the processing device for causing the processing device to determine an effective bulk modulus of the pump using an internal pressure change in the chamber during the amount of time between the first actuation point and the second actuation point, a fluid volume in the chamber at the first actuation point, and a change in the fluid volume during the amount of time between the first actuation point and the second actuation point. The effective bulk modulus may include the bulk modulus of the fluid and a mechanical bulk modulus of non-fluid components of the pump.

EXAMPLE #15

The pumping system of Example #14 may also comprise a position sensor positionable on the power end of the pump to sense a position of a crankshaft of the pump and generate a position signal representing the position of the crankshaft during operation of the pump. The fluid end of the pump may also include a plunger in the chamber that may be mechanically coupled to the crankshaft. The position signal may be usable in determining a movement of the plunger in the chamber. The memory device may comprise instructions executable by the processing device for causing the processing device to determine the change in the fluid volume using a volume of the fluid displaced in the chamber by the movement of the plunger during the amount of time between the first actuation point and the second actuation point.

EXAMPLE #16

The pumping system of Examples #10-15 may feature the computing device comprising a memory device including instructions executable by the processing device for causing the processing device to determine the bulk modulus of the fluid by determining a mechanical bulk modulus of non-fluid components of the pump by removing a first reciprocal of a known bulk modulus of a test fluid from a second reciprocal of an effective bulk modulus of the pump and removing a third reciprocal of the mechanical bulk modulus of the non-fluid components of the pump from the second reciprocal.

EXAMPLE #17

The pumping system of Examples #10-16 may also comprise the strain gauge positionable on an external surface of the fluid end of the pump to measure strain in the chamber and generate a strain signal representing the strain.

EXAMPLE #18

A method for determining a bulk modulus of fluid in a pump may comprise receiving, from a strain sensor coupled to a fluid end of the pump, a strain signal representing strain in a chamber of the pump. The method may also comprise determining, by a computing device, actuation points corresponding to valves in the chamber by identifying discontinuities in the strain signal, the actuation points including a first actuation point corresponding to a closing of a first valve in the chamber and a second actuation point corresponding to an opening of a second valve in the chamber. The method may also comprise determining an amount of time between the first actuation point and the second actuation point. The method may also comprise determining, by the computing device, a change in an internal pressure in the chamber during the amount of time between the first actuation point and the second actuation point by correlating the strain in the chamber with a predetermined measurement representing the internal pressure in the chamber. The method may also comprise determining, by the computing device, a bulk modulus of fluid isolated in the chamber during the amount of time between the first actuation point and the second actuation point using the change in the internal pressure in the chamber.

EXAMPLE #19

The method of Example #18 may feature determining the bulk modulus of the fluid isolated in the chamber to include multiplying an inverse of the change in the internal pressure in the chamber by a volume of the fluid isolated in the chamber at the first actuation point and a change in the volume of the fluid during the amount of time between the first actuation point and the second actuation point to determine an effective bulk modulus of the pump. The effective bulk modulus may include the bulk modulus of the fluid and a mechanical bulk modulus of non-fluid components of the pump.

EXAMPLE #20

The method of Examples #18-19 may feature determining the bulk modulus of the fluid isolated in the chamber to includes determining a mechanical bulk modulus of non-fluid components of the pump by removing a first reciprocal of a known bulk modulus of a test fluid from a second reciprocal of an effective bulk modulus of the pump and removing a third reciprocal of the mechanical bulk modulus of the non-fluid components of the pump from the second reciprocal.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A monitoring system for a pump, comprising:

a strain gauge positionable on a fluid end of the pump to measure strain in a chamber of the pump and generate a strain signal representing the strain in the chamber, the strain signal being useable in determining actuation points for valves in the chamber; and a computing device couplable to the strain gauge, the computing device including a processing device and a memory device, the memory device including instructions that are executable by the processing device for causing the processing device to:

receive, from memory, a predefined pressure value for an internal pressure of the chamber;

determine a change in the internal pressure in the chamber during an amount of time between the actuation points for the valves by correlating (i) a portion of the strain signal corresponding to the amount of time between the actuation points with (ii) the predefined pressure value; and determine a bulk modulus of fluid isolated in the chamber during the amount of time between the actuation points for the valves based on the change in the internal pressure in the chamber.

2. The monitoring system of claim 1, wherein the memory device further includes instructions that are executable by the processing device for causing the processing device to determine the actuation points for the valves in the chamber by identifying discontinuities in the strain signal, wherein the valves include a first valve and a second valve, wherein the actuation points include a first point corresponding to a closing of the first valve and a second point corresponding to an opening of the second valve.

3. The monitoring system of claim 1, wherein the memory device further includes instructions that are executable by the processing device for causing the processing device to determine the predefined pressure value using finite element analysis of the pump.

4. The monitoring system of claim 1, wherein the memory device further includes instructions that are executable by the processing device for causing the processing device to determine an effective bulk modulus of the pump using (i) the change in the internal pressure in the chamber during the amount of time between the actuation points, (ii) a fluid volume in the chamber at one of the actuation points, and (iii) a change in the fluid volume during the amount of time between the actuation points, and wherein the effective bulk modulus includes the bulk modulus of the fluid and a mechanical bulk modulus of non-fluid components of the pump.

5. The monitoring system of claim 4, further comprising:

a position sensor positionable on a power end of the pump to sense a position of a member of a rotating assembly of the pump and generate a position signal representing the position of the member during operation of the pump, the position signal being usable in determining a movement of a displacement member in the chamber, wherein the memory device further includes instructions that are executable by the processing device for causing the processing device to determine the change in the fluid volume using a volume of the fluid in the chamber displaced by the movement of the displacement member during the amount of time between the actuation points for the valves.

6. The monitoring system of claim 5, wherein the memory device comprises instructions executable by the processing device for causing the processing device to determine the movement of the displacement member by correlating the position of the member of the rotating assembly with a ratio representing a mechanical correlation of the displacement member to the member of the rotating assembly.

7. The monitoring system of claim 1, wherein the memory device further includes instructions that are executable by the processing device for causing the processing device to determine the bulk modulus of the fluid by:

determining a mechanical bulk modulus of non-fluid components of the pump by removing a first reciprocal of a known bulk modulus of a test fluid from a second reciprocal of an effective bulk modulus of the pump; and removing a third reciprocal of the mechanical bulk modulus of the non-fluid components of the pump from the second reciprocal.

8. The monitoring system of claim 1, wherein the strain gauge is positioned on an external surface of the fluid end of the pump to measure the strain in the chamber.

9. A pumping system, comprising:

a pump including a fluid end and a power end, the fluid end of the pump including a chamber having a first valve actuatable to a closed position at a first actuation point and a second valve actuatable to an open position at a second actuation point, an amount of time between the first actuation point and the second actuation point being detectable by a strain gauge; and a computing device couplable to the pump, the computing device including a processing device and a memory device including instructions that are executable by the processing device for causing the processing device to:

determine the first actuation point and the second actuation point by identifying discontinuities in a strain signal received from the strain gauge and representing strain in the chamber;

receive, from memory, a predefined pressure value for an internal pressure of the chamber;

determine a change in the internal pressure in the chamber during the amount of time between the first actuation point and the second actuation point by correlating a portion of the strain signal to the predefined pressure value; and determine a bulk modulus of fluid isolated in the chamber during the amount of time between the first actuation point and the second actuation point based on the change in the internal pressure in the chamber.

10. The pumping system of claim 9, wherein the memory device further includes instructions that are executable by the processing device for causing the processing device to receive the strain signal from the strain gauge.

11. The pumping system of claim 9, wherein the predefined pressure value is determined using finite element analysis of the pump.

12. The pumping system of claim 9, wherein the memory device further includes instructions that are executable by the processing device for causing the processing device to determine an effective bulk modulus of the pump using (i) the change in the internal pressure in the chamber during the amount of time between the first actuation point and the second actuation point, (ii) a fluid volume in the chamber at the first actuation point, and (iii) a change in the fluid volume during the amount of time between the first actuation point and the second actuation point, and wherein the effective bulk modulus includes the bulk modulus of the fluid and a mechanical bulk modulus of non-fluid components of the pump.

13. The pumping system of claim 12, further comprising:

a position sensor positioned on the power end of the pump to sense a position of a crankshaft of the pump and generate a position signal representing the position of the crankshaft during operation of the pump, wherein the fluid end of the pump further includes a plunger in the chamber that is mechanically coupled to the crankshaft, the position signal being usable in determining a movement of the plunger in the chamber, and wherein the memory device comprises instructions executable by the processing device for causing the processing device to determine the change in the fluid volume using a volume of the fluid displaced in the chamber by the movement of the plunger during the amount of time between the first actuation point and the second actuation point.

14. The pumping system of claim 9, wherein the memory device further includes instructions that are executable by the processing device for causing the processing device to determine the bulk modulus of the fluid by:

determining a mechanical bulk modulus of non-fluid components of the pump by removing a first reciprocal of a known bulk modulus of a test fluid from a second reciprocal of an effective bulk modulus of the pump; and removing a third reciprocal of the mechanical bulk modulus of the non-fluid components of the pump from the second reciprocal.

15. The pumping system of claim 9, further comprising the strain gauge positioned on an external surface of the fluid end of the pump to measure strain in the chamber and generate the strain signal representing the strain.

16. A method for determining a bulk modulus of fluid in a pump, comprising:

receiving, from a strain sensor coupled to a fluid end of the pump, a strain signal representing strain in a chamber of the pump;

determining, by a computing device, actuation points corresponding to valves in the chamber by identifying discontinuities in the strain signal, the actuation points including a first actuation point corresponding to a closing of a first valve in the chamber and a second actuation point corresponding to an opening of a second valve in the chamber;

determining an amount of time between the first actuation point and the second actuation point;

determining, by the computing device, a change in an internal pressure in the chamber during the amount of time between the first actuation point and the second actuation point by correlating the strain in the chamber with a predefined pressure value for the internal pressure in the chamber, wherein the predefined pressure value was previously determined and stored in memory; and determining, by the computing device, a bulk modulus of fluid isolated in the chamber during the amount of time between the first actuation point and the second actuation point using the change in the internal pressure in the chamber.

17. The method of claim 16, wherein determining the bulk modulus of the fluid isolated in the chamber includes multiplying an inverse of the change in the internal pressure in the chamber by a volume of the fluid isolated in the chamber at the first actuation point and a change in the volume of the fluid during the amount of time between the first actuation point and the second actuation point to determine an effective bulk modulus of the pump, wherein the effective bulk modulus includes the bulk modulus of the fluid and a mechanical bulk modulus of non-fluid components of the pump.

18. The method of claim 16, wherein determining the bulk modulus of the fluid isolated in the chamber includes:

determining a mechanical bulk modulus of non-fluid components of the pump by removing a first reciprocal of a known bulk modulus of a test fluid from a second reciprocal of an effective bulk modulus of the pump; and removing a third reciprocal of the mechanical bulk modulus of the non-fluid components of the pump from the second reciprocal.

19. The method of claim 16, further comprising:

determining a change in a fluid volume in the chamber during the amount of time between the first actuation point and the second actuation point based on a volume of the fluid displaced in the chamber by a movement of a plunger in the pump during the amount of time between the first actuation point and the second actuation point;

determining an effective bulk modulus based on the change in the fluid volume; and determining the bulk modulus based on the effective bulk modulus.

20. The method of claim 16, wherein the predefined pressure value is generated using finite element analysis.

* * * * *